United States Patent [19]

Bauer et al.

[11] Patent Number: 4,834,030

[45] Date of Patent: May 30, 1989

[54] DIESEL INTERNAL COMBUSTION ENGINE

[75] Inventors: Lothar Bauer; Wolfgang Strusch, both of Cologne; Ernst-Siegfried Hartmann, Overath; Herbert Schleiermacher, Bruehl; Juergen Wahnschaffe, Bergisch Gladbach, all of Fed. Rep. of Germany

[73] Assignee: Kloeckner-Humboldt-Deutz AG, Fed. Rep. of Germany

[21] Appl. No.: 123,223

[22] Filed: Nov. 20, 1987

[30] Foreign Application Priority Data

Nov. 20, 1986 [DE] Fed. Rep. of Germany ..... 3639691

[51] Int. Cl.[4] ..... F02F 1/34; F02F 1/40

[52] U.S. Cl. ..... 123/41.72; 123/41.57; 123/41.62; 123/41.74; 123/41.82 R

[58] Field of Search ..... 123/41.57, 41.72, 41.74, 123/41.79, 41.82 R, 41.6, 41.62, 41.67

[56] References Cited

U.S. PATENT DOCUMENTS

| | | | |
|---|---|---|---|
| 2,085,810 | 7/1937 | Ljungstrom | 123/41.72 |
| 4,109,617 | 8/1978 | Ernest | 123/41.74 |
| 4,175,503 | 11/1979 | Ernest | 123/41.79 X |
| 4,365,593 | 12/1982 | Pomfret | 123/41.82 R X |
| 4,377,990 | 3/1983 | Seidl | 123/41.82 R |
| 4,471,726 | 9/1984 | Seidl | 123/41.82 R |
| 4,672,923 | 6/1987 | Wahnschaffe et al. | 123/41.74 |
| 4,714,058 | 12/1987 | Oda et al. | 123/41.82 R X |

FOREIGN PATENT DOCUMENTS

| | | | |
|---|---|---|---|
| 2904167 | 8/1980 | Fed. Rep. of Germany | 123/41.72 |

*Primary Examiner*—Tony M. Argenbright
*Assistant Examiner*—Eric R. Carlberg
*Attorney, Agent, or Firm*—Charles L. Schwab

[57] ABSTRACT

An diesel internal combustion engine with a liquid-cooled cylinder crank casing (1) includes a cylinder head gasket (300) which can be used with either a liquid-cooled cylinder head (200) or an air-cooled cylinder head (100).

26 Claims, 8 Drawing Sheets

DIESEL INTERNAL COMBUSTION ENGINE

TECHNICAL FIELD

This invention relates to a diesel internal combustion engine and particularly to a diesel engine designed to optionally use an air-cooled cylinder head or a liquid-cooled cylinder head.

OBJECTS AND BRIEF SUMMARY OF THE INVENTION

In order to be competitive in the marketplace, a manufacturer of diesel engines must be able to offer engines suitable for each potential customer. A great range of engines is therefore necessary, wherein engines of a design series, i.e., with the same stroke volume per cylinder, should be made up of a minimal number of components and with maximum commonality of components.

An object of this invention is to create a diesel internal combustion engine for which either a liquid-cooled cylinder head or an air-cooled cylinder head can be bolted onto a liquid-cooled cylinder crank casing. This object is met by the specific characteristics of the first claim.

The liquid-cooled cylinder crank casing is designed in such a way that either an air-cooled cylinder head or a liquid-cooled cylinder head can be used on it. The cylinder head gasket and engine are so designed that the cylinder head gasket can be used with either cylinder head.

The liquid-cooled cylinder crank casing includes a series of side-by-side (in-line) cylinder pipes, each surrounded by a ring-shaped cylinder cooling jacket chamber which opens toward the cylinder head ("open-deck" construction). The cylinder heads for a series of "in-line" cylinders are integrally formed as a block cylinder head made preferably of gray cast iron.

In both versions of the engine, that is, with an air-cooled cylinder head or with a liquid-cooled cylinder head, oil is used as a coolant. The oil also serves as a lubricating oil for the engine.

BRIEF DESCRIPTION OF THE DRAWINGS

The various features of the invention are hereinafter described in detail and illustrated in the drawings, in which.

DETAILED DESCRIPTION OF THE DRAWINGS

The description is subdivided as follows:

I. Cylinder Crank Casing
II. Air-Cooled Cylinder Head
III. Liquid-Cooled Cylinder Head
IV. Cylinder Head Gasket

Part I - Cylinder Crank Casing

Figure 1:
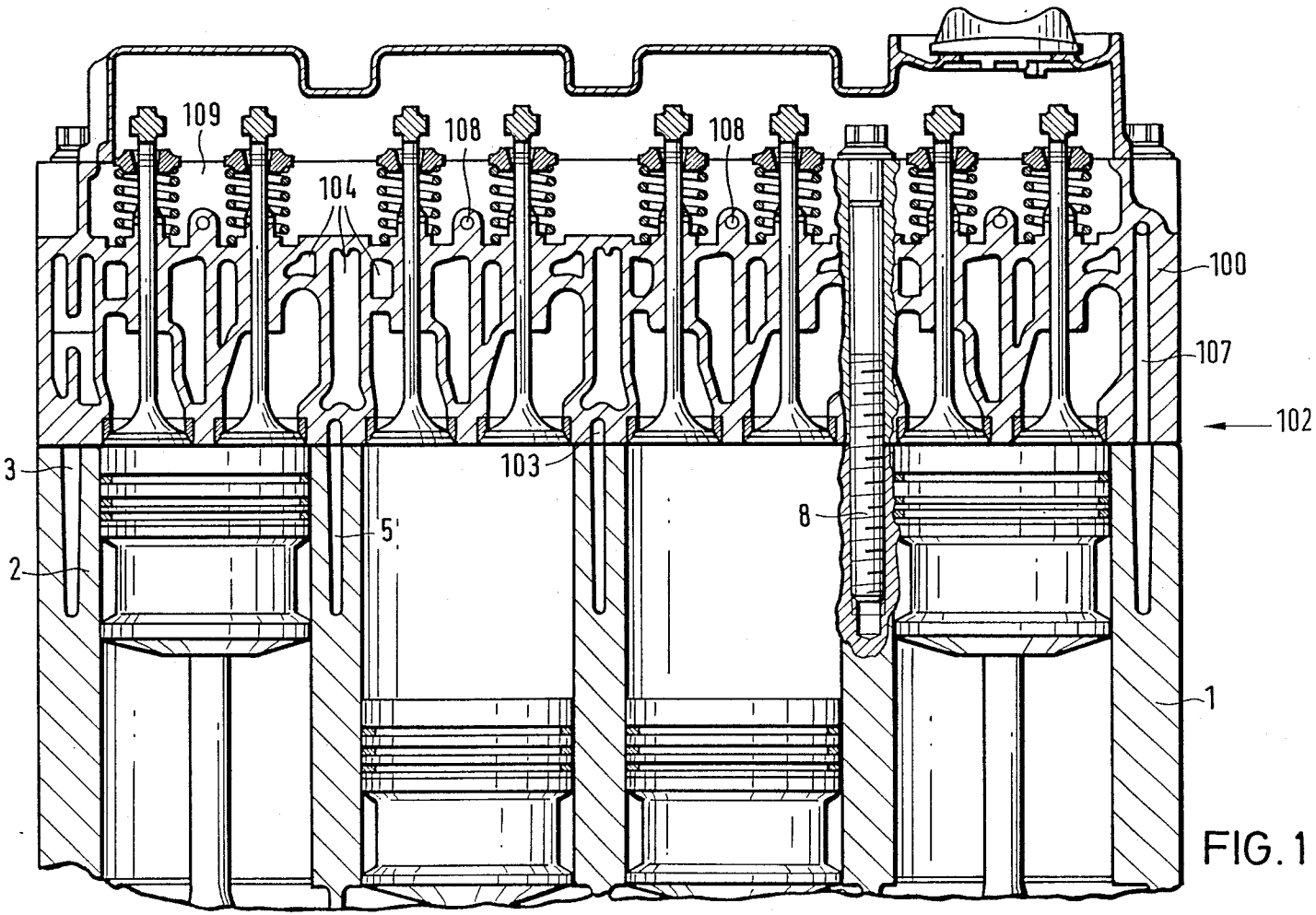
FIG. 1 is a lnogitudinal vertical section of an internal combustion engine of this invention with a mounted air-cooled cylinder head.
Figure 2:
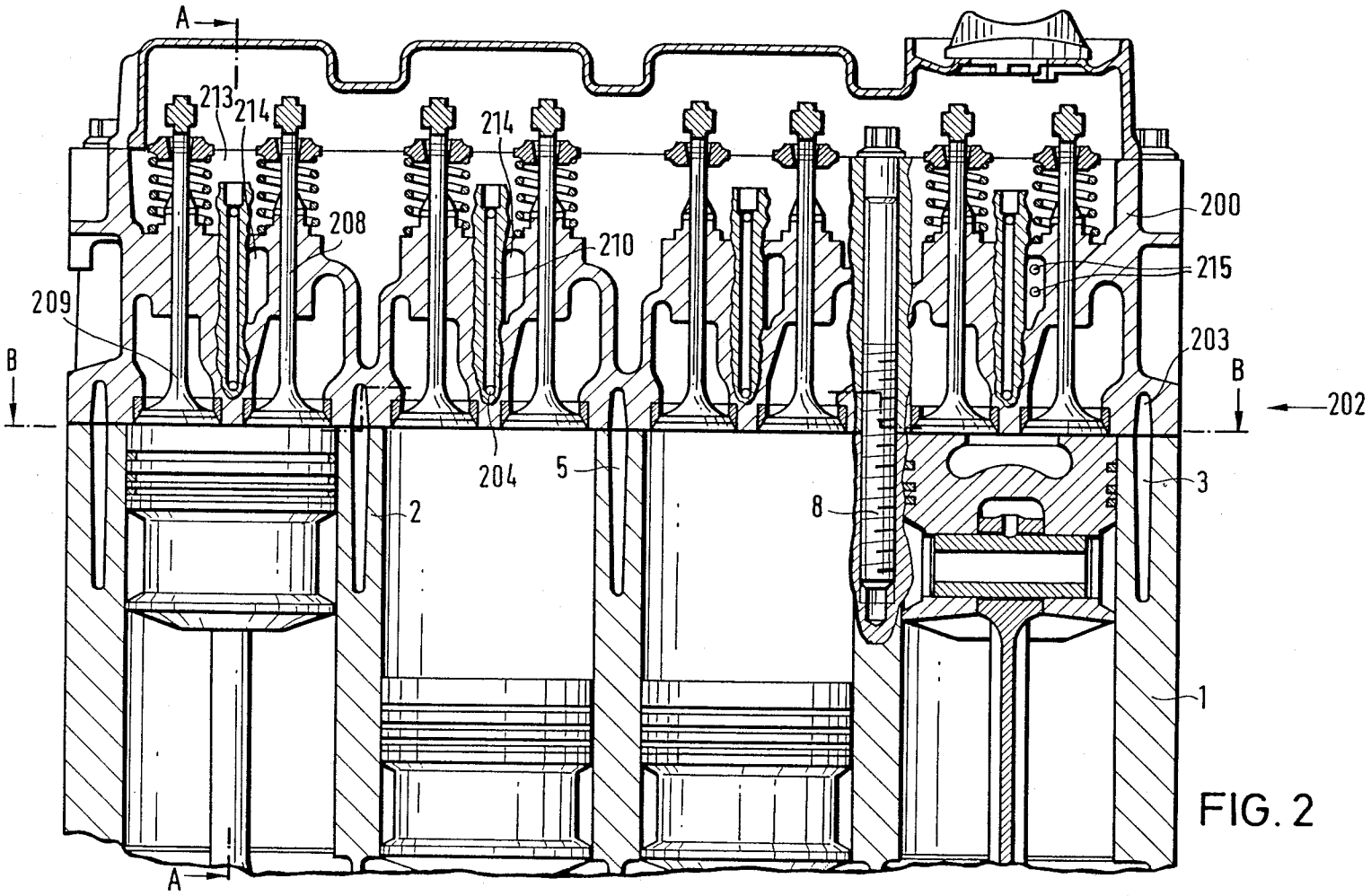
FIG. 2 is a longitudinal vertical section of an internal combustion engine of this invention with a mounted liquid-cooled cylinder head.
Figure 3:
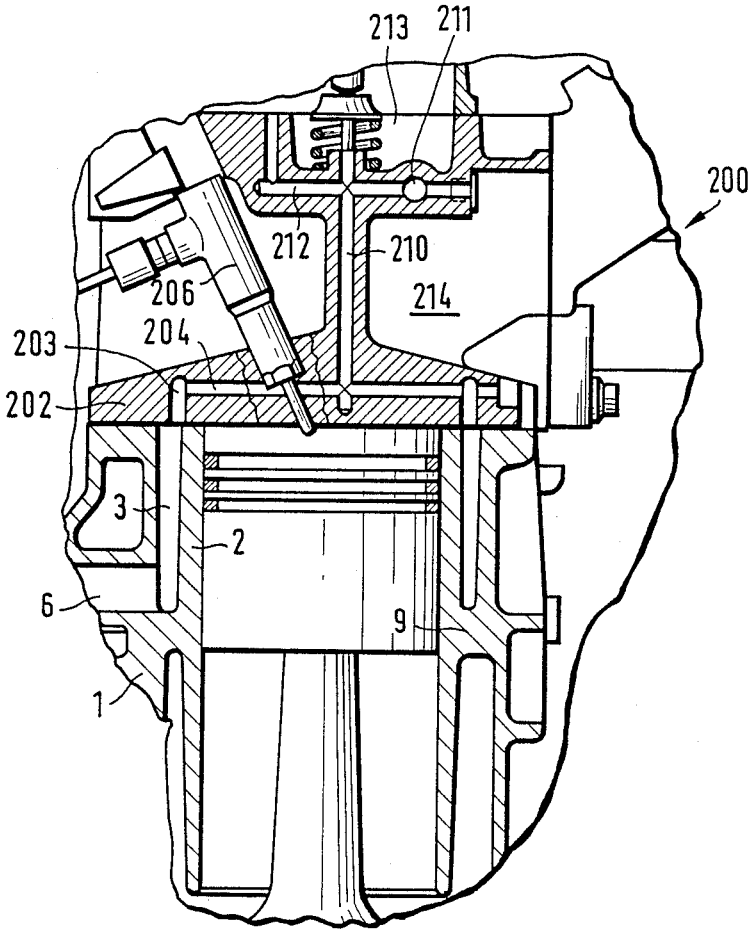
FIG. 3 is a section view taken on the line A-A in FIG. 2.
Figure 5:
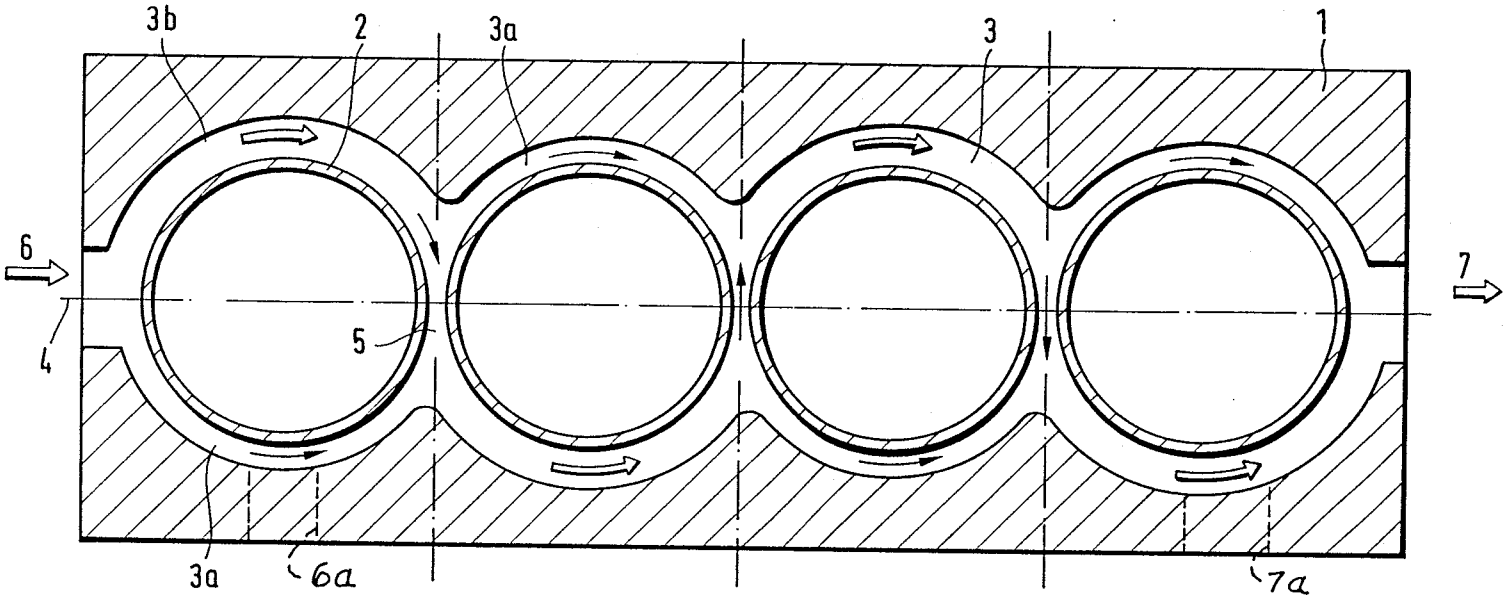
FIG. 5 is a horizontal section through the cylinder crank casing.

FIGS. 1 and 2 show the common cylinder crank casing 1 in longitudinal vertical section, and FIG. 3 shows it in a transverse vertical section through the axis of a cylinder. FIG. 5 shows a horizontal section through the cylinder crank casing.

The cylinder crank casing 1 includes a plurality of cylinder pipes 2 each surrounded by a ring-shaped cylinder cooling jacket chamber 3 whereby the cylinder cooling jacket chambers 3 are open toward the cylinder head 100, 200 ("open deck" construction). The cylinder cooling jacket chamber 3 is designed to be conical in axial direction, whereby the diametric width of the cylinder cooling jacket chamber 3 increases in the direction toward the cylinder head. Because of the conical section shape of the cylinder cooling jacket chamber 3, it is easier to clean after casting and, what is more important, the cooling increases with increasing proximity to the cylinder head 100, 200 because of the increasing volume of flow.

The cylinder cooling jacket chamber 3 extends in an axial direction into the cylinder crank casing 1 only as far as approximately two-thirds ($\frac{2}{3}$) of the piston stroke. Thus, only the area of the cylinder crank casing 1 which is thermically critical is intensively cooled. A cylinder crank casing intermediate deck 9 which traverses the entire cylinder series is provided beneath the cylinder cooling jacket chamber 3. The cylinder pipes 2 extend into each other in the space between adjacent cylinders beneath the intermediate deck 9 (FIGS. 1, 2) while they otherwise depend in an independent, self-supporting manner (FIG. 3). The parts of the cylinder pipes 2 beneath the intermediate deck 9 may be reinforced by the provision of ribs, supports or reinforcements extending in the direction toward the lateral side walls of the cylinder crank casing. This is particularly advantageous with respect to the rigidity of the cylinder crank casing 1.

The cylinder heads 100, 200 are fastened to the cylinder crank casing 1 with cylinder head bolts 8. An effective length of thread on the end of the cylinder head bolts 8 threadedly engages a drilled and tapped opening extending into a crank casing area at the crank-side end of the cylinder cooling jacket chamber 3, which is the level of the intermediate deck 9. This anchoring of the head bolts insures sufficient compression of the cylinder head gasket 300 against that part of the crank casing 1 between the combustion chamber and the cylinder cooling jacket chamber 3.

FIG. 5 shows that, in the direction of the longitudinal plane 4 through the axes of the cylinders, the cylinder cooling jacket chamber 3 of one cylinder extends into the cylinder cooling jacket chamber 3 of an adjacent cylinder in such a way that a gap or cross-over passage 5 is formed between two adjacent cylinders for the passage of the coolant. The axes of the cylinder cooling jacket chambers 3 are displaced from the axes of the cylinder pipes 2, whereby two adjacent cylinder cooling jacket chambers 3 are displaced in inverse directions from the longitudinal plane 4 of the cylinder series. Because of this offset displacement, the cylinder cooling jacket chamber 3 consists of partial cooling chambers 3*a*, 3*b* of unequal sizes on opposite lateral sides of the longitudinal plane 4 of the cylinder series. Thus two partial cooling chambers 3*a*, 3*b* are provided for each cylinder within the cylinder cooling jacket chamber 3, which are disposed on opposite sides of the longitudinal plane 4. Partial cooling chamber 3*b* has a greater flow cross-section for the coolant than the other partial cooling chamber 3*a* on the other side of the longitudinal plane 4. In the adjacent cylinder, the partial cooling chambers 3*a*, 3*b* are reversed relative to the longitudinal plane 4 so that the partial cooling chambers 3*a*, 3*b* alternate on one side of the longitudinal center axis 4 and thus so do the areas of the flow cross-sections and the coolant flow volumes.

Because of the displacement of the axes of the cylinder cooling jacket chambers 3 and the consequent different flow cross-section for the coolant on opposite sides of the longitudinal plane 4, a meandering course is created for a partial flow of coolant around the cylinder pipes 2. In this way the total cylinder pipe surface is cooled equally, particularly in the space between two cylinders.

The introduction of obstacles into the cylinder cooling jacket chambers can also influence the cross-section off flow without the displacement of the axes of the cylinder cooling jacket chambers 3 from the axes of the cylinder pipes 2.

As shown in FIG. 5, the coolant flows through a coolant inlet 6 into the cylinder cooling jacket chamber 3 of the first cylinder. The coolant inlet 6 can be arranged at the front side or along the longitudinal side of the cylinder series. An alternate coolant inlet is indicated by broken lines 6*a* in FIG. 5 which discharges into the partial cooling chamber 3*a*. The coolant flow subsequently is divided into two partial flows by the partial cooling chambers 3*a* and 3*b*. Since the cross-section of flow of the partial cooling chamber 3*b* is greater than that of 3*a*, a greater quantity of coolant flows through chamber 3*b*. In the cross-over passage 5 between the cylinders, both partial flows join together again. In the adjacent cylinder, the partial cooling chamber with the greater cross-section of flow 3*b* is located on the opposite side of the longitudinal plane 4 than in the previous cylinder. Thus, a primary flow of coolant crosses the longitudinal plane 4 in the cross-over passage 5 and results in sufficient rinsing/flushing of the entire cylinder pipe surface, but especially for those parts facing the cross-over passage 5. After flowing through the cylinder cooling jacket chambers 3 of all cylinders, the coolant leaves the cylinder series through a coolant outlet 7. Here an alternate coolant outlet is indicated by broken lines 7*a* at a lateral side of the engine at the end one of the series of cylinders.

In the FIG. 5 embodiment, a series of in-line cylinders are served by a single coolant inlet 6 and a single coolant outlet 7 which are located, respectively, at the cylinders at the opposite ends of the engine. Alternatively, each cylinder may have at least one coolant inlet at the cylinder head end of the cylinder cooling jacket chamber 3. This alternate construction is particularly suitable for an engine with a liquid-cooled head wherein components of the cylinder head are cooled after the coolant flows through the cylinder cooling jacket chamber 3. This design embodiment will be described hereinafter in greater detail.

Oil is ideally suited for use as coolant because the internal combustion engine is not only cooled but is also simultaneously lubricated by the same oil. Accordingly, only one cooling and lubricating medium is necessary.

In the following description, two differing cylinder heads 100, 200, which can be mounted on the previously described cylinder crank casing 1, are described in detail. Common to both is the fact that the cylinder heads for a series of cylinders are integrally formed as a block cylinder head which is fabricated from gray cast iron. A block cylinder head for a plurality of in-line cylinders is especially cost-efficient in manufacture and assembly. It may, however, also prove expedient to use individual cylinder heads.

Part II - Air-Cooled Cylinder Head

Figure 6:
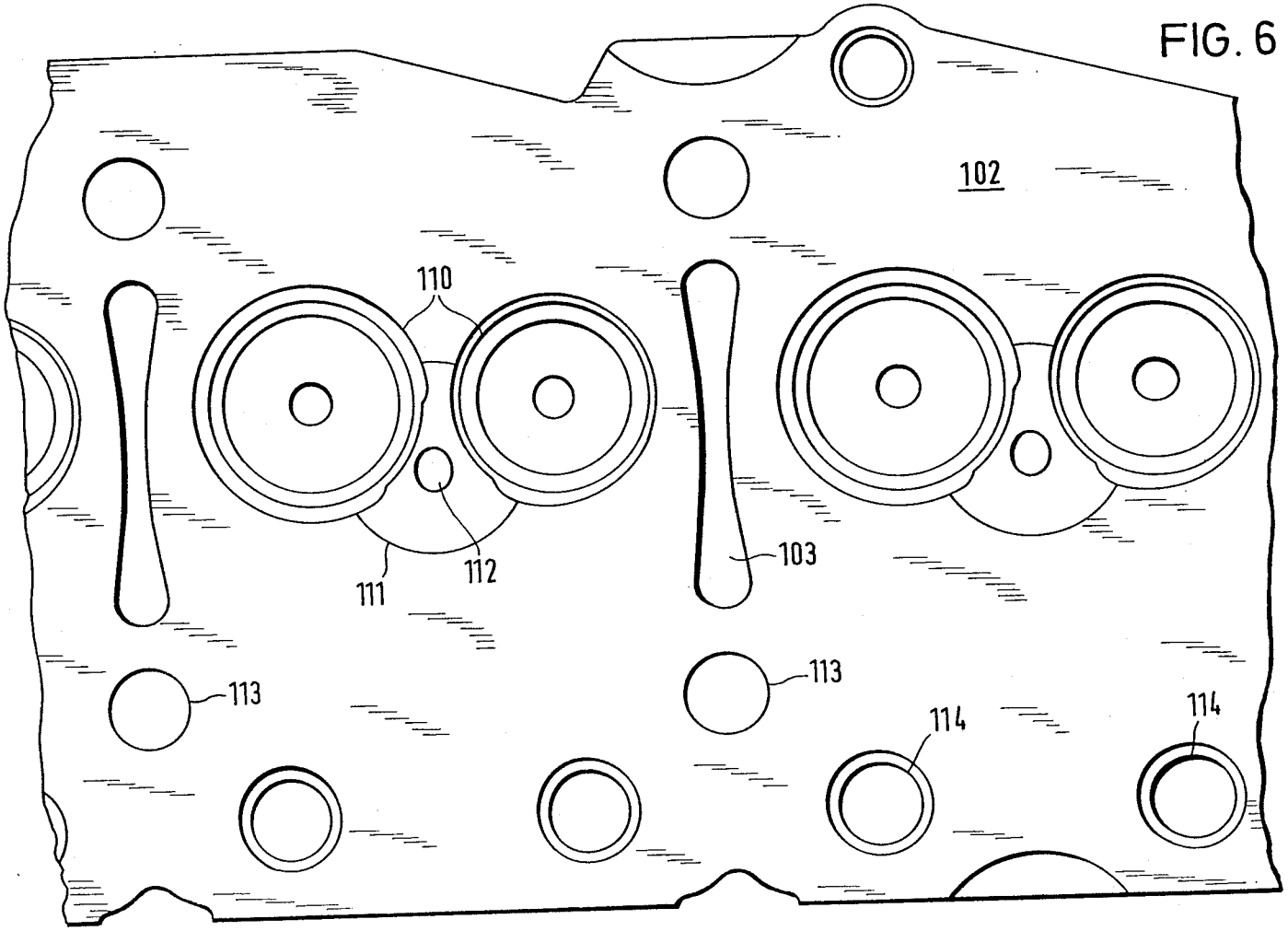
FIG. 6 is a bottom view of the cylinder head base of the air-cooled cylinder head.
Figure 7:
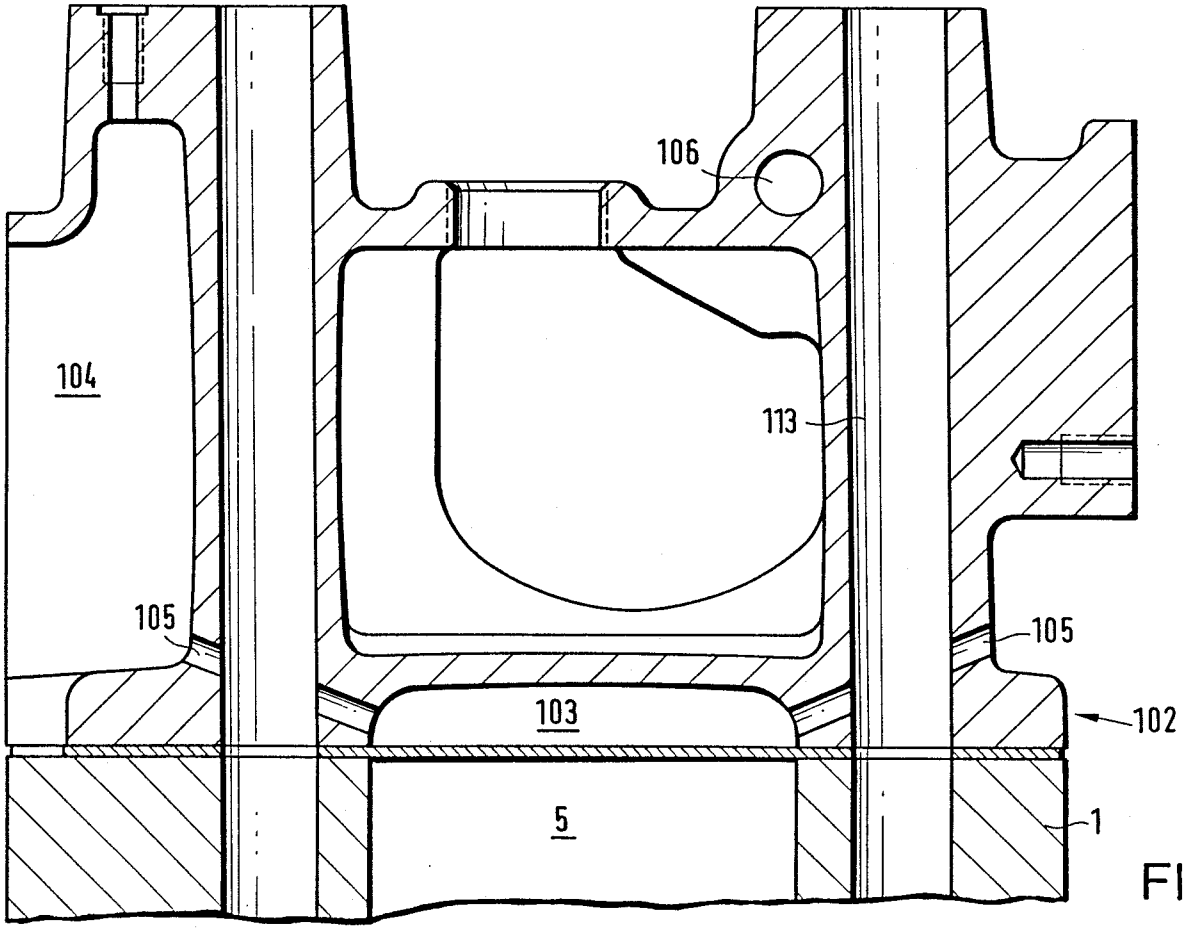
FIG. 7 is a partial cross-section through an engine of this invention with an air-cooled cylinder head in the area between adjacent cylinders.

The air-cooled cylinder head 100 is illustrated in FIGS. 1, 6 and 7.

The cylinder head base 102 is provided with a transverse slot-shaped groove or slot 103 in the cylinder head base 2 for better cooling on its combustion chamber side between adjacent cylinders. The slot 103 is directly above the cross-over passage 5 of adjacent cylinder cooling jacket chambers 3. FIG. 6 shows the slot 103 in a bottom view of the cylinder head base. It can be clearly recognized that the slots are at right angles to a line connecting the intake and exhaust valves 110 and the width of the slots 103 increases with an increase in distance from the mentioned connecting line. In addition, an injection nozle 112 which is positioned between the intake and exhaust valves 110 in the support or bridging area 111 of the head base 102 is illustrated in FIG. 6. The number 113 represents the boreholes for the cylinder head bolts, and the number 114 represents the push rods for the valves.

In the embodiment show in FIG. 7, which is a cross-sectional view through the cylinder head 100 in the area between two cylinders, the slots 103 are ventilated via boreholes or passages which lead to a cooling air chamber 103. Boreholes or passages 105 may be provided at opposite ends of the slots 103 so that cooling air passes through the slots 103. In the event the air-cooled cylinder head 100 includes the beforementioned passages 105, then the head gasket 300 will not include the openings 302 and the slots 103 will not be in communication with the cooling jacket chambers 3.

In another embodiment of the invention, the slots 103 are connected via openings 302 in the cylinder head gasket 300 (see the description for FIG. 8) with the liquid-cooled cylinder cooling jacket chamber 3 and thus the slots 103 are liquid cooled.

In addition, a distribution conduit 106 is provided in the cylinder head 100 which extends longitudinally the full length of the head. The conduit 106 is connected at one of its ends to the cylinder cooling jacket chamber 3 of an end cylinder via a vertical borehole 107 which extends through the cylinder head gasket 300. The distribution conduit 106 is shown in cross-section in FIG. 7 and the borehole 107 is shown in FIG. 1. Individual branch boreholes 108 lead from the distribution conduit 106 into the valve rocker bearing chamber 109 (FIG. 1) in order to lubricate the components which are found there. Thus, the oil serves as a lubricant as well as a coolant.

It is also advantageous to pass the heated oil through a heat exchanger which heats, for example, the driver's cabin or passenger compartment.

There is one advantageous design embodiment which is not shown in the drawings, i.e., the cooling air flow is subdivided into two partial flows, one partial flow being routed across an engine oil cooler (a heat exchanger) and the other partial flow cooling in the cylinder head 100.

Part III - Liquid-Cooled Cylinder Head

Figure 4:
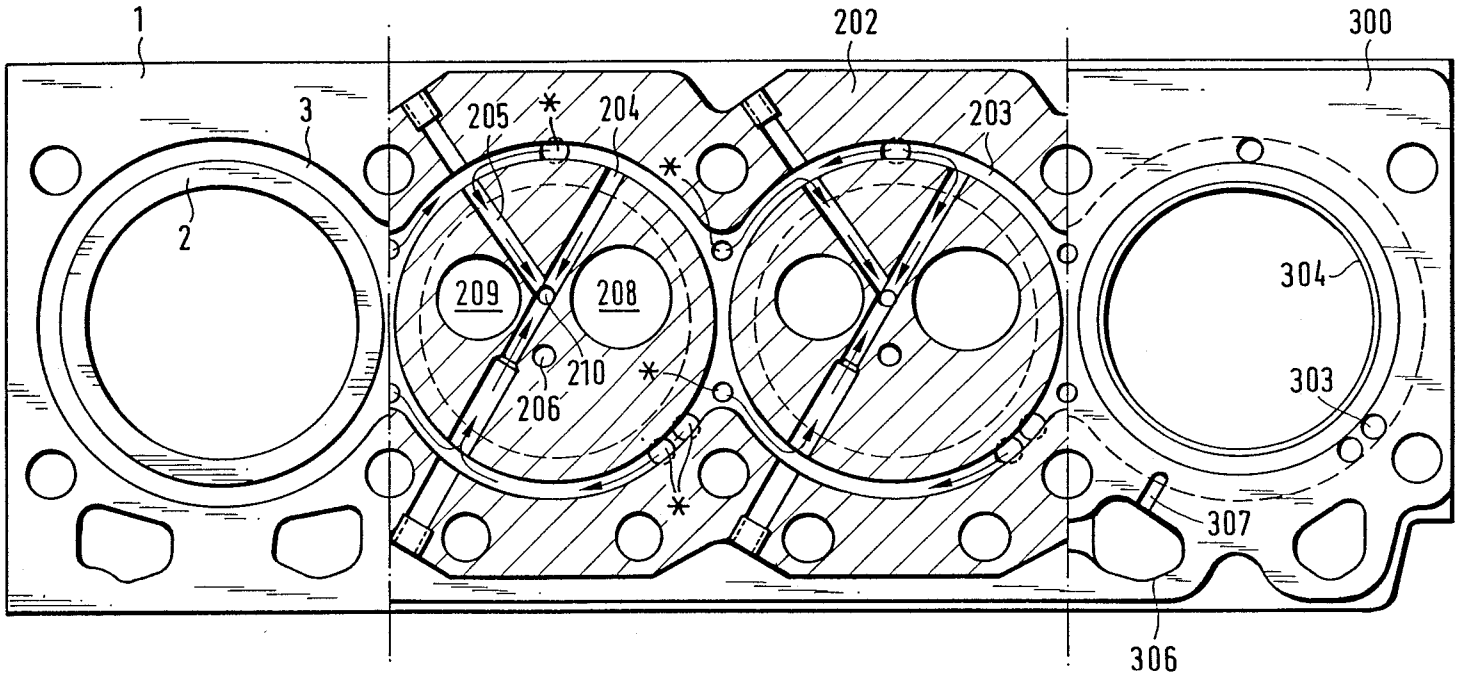
FIG. 4 is a section view taken on the line B-B in FIG. 2.

The liquid-cooled cylinder head 200 of this invention is shown in FIGS. 2, 3 and 4.

FIG. 2 shows the cylinder head 200 in longitudinal vertical section. FIG. 3 is a vertical transverse section through a cylinder axis as viewed along line A—A in FIG. 2 and FIG. 4 is a section taken on the line B—B in FIG. 2.

In the cylinder head base 202, an annular chamber 203 is located above the cylinder cooling jacket chamber 3 of the cylinder crank casing 1 which is open in the direction of the cylinder crank casing 1. Adjacent annular chambers 203 overlap or merge into one another in the space between adjacent cylinders.

Annular chamber 203, like the cylinder cooling jacket chamber 3 in the cylinder crank casing 1, is conical in axial direction, whereby for annular chamber 203 its width increases in the direction toward the cylinder crank casing 1. Because of this feature the cooling in the transition area between the cylinder head 200 and the cylinder crank casing 1 is intensified. Also, the flushing process (cleaning), required after casting the head, is made easier.

It is also advantageous to design the cross-section of flow of an annular chamber 203 so that it is larger on one side of the longitudinal vertical plane 4 of the cylinder series than on the other side, and to design the adjacent annular chamber 203 to have an inverse unequal cross-section of flow relative to the longitudinal plane 4. These varying cross-sections of flow in the annular chamber 203 relative to the longitudinal plane 4 can, as provided in the cylinder cooling jacket chambers 3, be achieved by displacing the axes of annular chambers 203 alternately on opposite lateral sides of the longitudinal plane 4.

In order to provide cooling for the especially heavily stressed bridging area covering the combustion chamber (the end of the cylinder), a fluid conducting borehole 204 (FIG. 4) is provided in the cylinder head base 202 which traverses the bridging area and is connected in a fluid-conducting manner at its opposite ends with the annular chamber 203. The fluid conducting borehole 204 advantageously passes between the injection nozzle 206 and the exhaust valve 209.

In addition, a connecting passage or borehole 205 is provided in the base 202 of the head on the side of a line between the intake and exhaust valves 208, 209 opposite to the side of the line on which the injection nozzle 206 is located. The connecting borehole 205 is disposed at an angle of approximately 65 degrees to the fluid conducting borehole 204 and has one end connected thereto. The other end of the passage 205 is connected to the annular chamber 203. The discharge of the connecting borehole 205 into the fluid conducting borehole 204 is located approximately on a line between said intake and exhaust valves.

In an additional desirable borehole arrangement (which is not illustrated in the figures) the fluid conducting borehole 204 passes between the intake valve 208 and the injection nozzle 206 and the connecting borehole 205 lies between the exhaust valve 209 and the injection nozzle and extends between the annular chamber 203 and the fluid conducting borehole 204 connecting with the latter in the bridging area between the intake and exhaust valves. It is especially desirable that the borehole 205 be a single straight borehole.

At the discharge of borehole 205 into the borehole 204, a vertical axially extending borehole 210 (FIG. 3) leads into a distribution conduit 211 so that the cylinder cooling jacket chamber 3, the boreholes 204, 205 and the distribution conduit 211 are connected to one another in a fluid-conducting manner. The distribution conduit 211 leads through the entire longitudinal length of the cylinder head 200.

Proceeding from the distribution conduit 211, boreholes or branch passages 212 lead into the valve rocker bearing chamber 213. The oil which is brought to this location serves primarily to lubricate the valve operating components located there.

In order to avoid carbonization of the lubricating oil because of the heat of the exhaust channel, an air chamber 214 is arranged between the valve rocker bearing chamber 213 and the exhaust channel which thermically decouples the valve rocker bearing chamber 213 from the exhaust channel and thus the oil which drops onto the floor of the valve rocker bearing chamber 213 does not carbonize. The air chamber 214 traverses the cylinder head 200 in a transverse direction and, at its opposite ends, is connected with the atmosphere. Preferably, a forced flow of cooling air is directed through the cooling chamber 214.

In addition, it is desirable to pass the axially extending borehole 210 through the air chamber 214 in such a way that it is immediately adjacent to the exhaust valve guide.

Since the air chambers 214 extend in the transverse direction of the engine, they are well suited for the passing of operating lines 215 from one lateral side of the engine to the other. These lines 215 can be, among other things, pipelines or tubing or electrical lines.

During the operation of the internal combustion engine, the coolant flows through the cylinder cooling jacket chambers 3 in the cylinder crank casing 1 and proceeds via openings in the cylinder head seal 300 into the annular chamber 203. The exact position of the openings is described in Part IV. In order to make this clearer, the inlet for the coolant into the annular chamber 203 is indicated in FIG. 4 with an asterisk. The coolant flows subsequently within the annular chamber 203 either into the borehole 205 or into the borehole 204 and from there into the distribution conduit 211 via the axially extending borehole 210. Individual branch boreholes or pasasges 212 lead from the distribution conduit 211 into the valve rocker bearing chamber 213. There the coolant serves as a lubricant.

Part IV - Cylinder Head Seal

Figure 8:
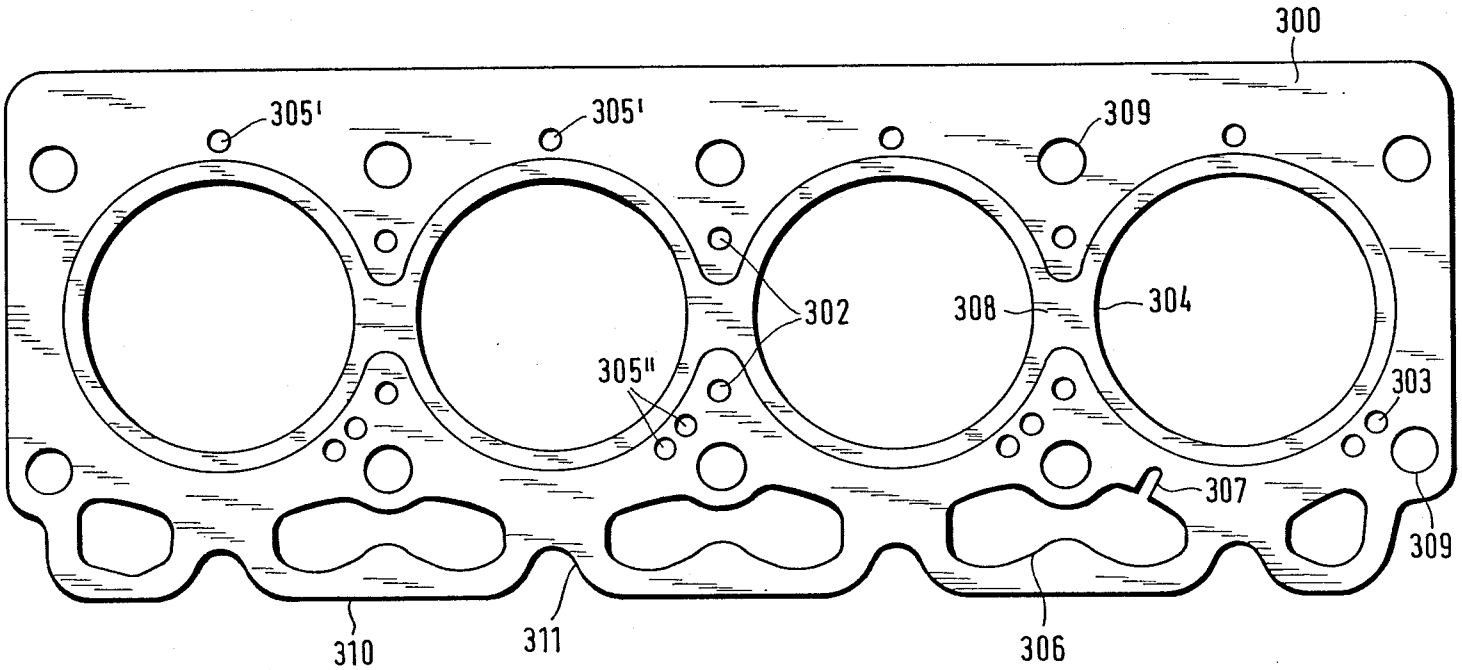
FIG. 8 shows a cylinder head gasket of this invention.

In FIG. 8 the cylinder head gasket 300 is shown in an overhead view. The important feature of this cylinder head gasket is that it can be used for the air-cooled cylinder head 100 as well as for the liquid-cooled cylinder head 200. The prerequisite for this is that the engines have the same number of cylinders. Those openings in the gasket 300 for the coolant for the liquid-cooled cylinder head 200, which are not necessary when an air-cooled head is used, are covered by the cylinder head base 102 on the combustion chamber side of an air-cooled cylinder head 100. The situation is analogous for the unneeded coolant openings in the gasket 300 for the air-cooled cylinder head when using the liquid-cooled cylinder head 200.

The cylinder openings 304 in the cylinder head gasket 300, which is fabricated from, for instance, a soft material with embedded sheet metal, are provided with a sheet metal rim 308 around the combustion chamber area. These sheet metal rims 308 overlap into one another in the interspace between two cylinder openings 304. Four openings 309 each are arranged around the cylinder openings 304 for the cylinder head bolts 8. An opening 306 which is shaped like the number "8" is arranged on the injection valve side 310 between two cylinder openings 304, which serves as a through-passage for the push rods.

Openings are formed in the gasket 300 in the overlapping area of the cylinder cooling jacket chamber 3 and the annular chamber 203, the arrangement and purpose of which are explained in the following description. The openings 302 and 303 are used for the air-cooled cylinder head 100 and the openings 305', 305'' and the slot-shaped extension 307 are used for the liquid-cooled cylinder head 200.

At one longitudinal end of the cylinder head seal 300 an opening 303 is provided which, with an air-cooled cylinder head 100, creates a fluid connection between the cylinder cooling jacket chamber 3 and the distribution conduit 106 via the borehole 107. The opening 303 is disposed adjacent an opening 309 for a cylinder head bolt 8 at one end of the engine on the injection valve side 310 of the gasket 300 and is located between the adjacent opening 309 and the sheet metal rim 308.

The two openings 302 formed in the cylinder head seal 300 are positioned between two cylinder openings 304 substantially on a line perpendicular to the longitudinal plane 4 through the axes of the cylinder openings 304. These openings 302 connect the cylinder cooling jacket chamber 3 with the slot 103 in the air-cooled cylinder head 100.

Openings 305 are arranged in the cylinder head seal 300 in the overlapping area of the cylinder cooling jacket chamber 3 and the annular chamber 203 for the liquid-cooled cylinder head 200. These openings are subdivided so they can be more easily recognized as 305' and 305''.

An opening 305' is arranged in the overlapping area of the cylinder cooling jacket chamber 3 and the annular chamber 203 approximately halfway between the annular chamber connections with the fluid conducting borehole 204 and the connecting borehole 205. In FIG. 4 the inlet for the coolant from opening 305' into the annular chamber 203 is indicated by an asterisk. In addition, two openings 305'' are provided in the gasket 300 for two discharges into the annular chamber 203 and thence into opposite ends of borehole 204. These openings 305'' are on the opposite side of the borehole 204 as the connecting borehole 205. The number and size of the openings 305 is determined in accordance with the quantity of coolant required. The flow of the coolant through the annular chamber 203 is indicated in FIG. 4 by arrows. By appropriate arrangement of the openings 305, the flow in the annular chamber 203 can be varied and certain areas can, if desired, be more intensively cooled than others.

It may be advantageous to provide openings 305 only at one end of the cylinder head seal 300.

As has already been described above, an opening which corresponds in shape to the number "8" is provided between two cylinder openings 304 of the cylinder head seal 300 through which push rods for adjacent cylinders extend. In accordance with one embodiment of the invention, a slot-shaped extension or recess 307 extends from the opening 306 into the part of the cylinder head seal 300 which lies over the cylinder cooling jacket chamber 3. By using this slot-shaped recess 307, the quantity of flow of the coolant can be increased and thus greater cooling is achieved. In addition, the recess 307 serves the purpose of providing ventilation. Preferably the slot-shaped extension 307, as shown in FIG. 8, is located in the opening 306 which is adjacent to the end cylinder of the series of cylinders.

The cylinder head seal 300 is indented on the injection valve side 310 in the area between two of the openings 306 in the direction toward the longitudinal plane 4, whereby this indentation 311 extends into the cylinder head seal 300 approximately one-half the width of the opening 306. The cylinder head bases 102, 202 are preferably designed in their outer contours to be congruent to the cylinder head seal 300.

In summary, this invention creates a diesel internal combustion engine which can be fabricated easily and with minimum expense and which, as required, can be provided with either an air-cooled cylinder head or a liquid-cooled cylinder head. A single head gasket is used with either cylinder head.

The embodiments of the invention in which an exclusive property or privilege is claimed are defined as follows:

1. A diesel internal combustion engine having a liquid-cooled cylinder crank casing (1) with a plurality of cylinder pipes (2) whose axes lie in a longitudinal plane (4) and a liquid-cooled cylinder head (200) secured to said casing, characterized by said cylinder crank casing (1) including a cylinder cooling jacket chamber (3) surrounding each cylinder pipe (2), said cylinder cooling jacket chambers (3) being open in the direction of said cylinder head (200) and wherein adjacent cylinder cooling jacket chambers (3) merge with one another at the longitudinal plane (4) of the engine, an annular chamber (203) formed in the combustion chamber side of said cylinder head (200) above each of said cylinder cooling jacket chambers (3) with adjacent annular chambers merging with one another at the longitudinal plane (4) of the engine, a cylinder head gasket (300) operatively disposed between and in sealing relation with said cylinder crank casing (1) and said cylinder head (200), said cylinder head gasket (300) including openings connecting said cylinder cooling jacket chambers (3) with said annular chambers (203), said annular chamber (203) being conical in axial section, whereby the width of the annular chamber (203) increases in the direction toward said cylinder crank casing (1), the cross-section of flow of one annular chamber (203) being greater on one side of the longitudinal plane (4) than on the other side, and the adjacent annular chamber (203) having an inverse cross-section of flow relative to the longitudinal plane (4).

2. A diesel internal combustion engine having a liquid-cooled cylinder crank casing (1) with a plurality of cylinder pipes (2) whose axes lie in a longitudinal plane (4) and a liquid-cooled cylinder head (200) secured to said casing, characterized by said cylinder crank casing (1) including a cylinder cooling jacket chamber (3) surrounding each cylinder pipe (2), said cylinder cooling jacket chambers (3) being open in the direction of said cylinder head (200) and wherein adjacent cylinder cooling jacket chambers (3) merge with one another at the longitudinal plane (4) of the engine, an annular chamber (203) formed in the combustion chamber side of said cylinder head (200) above each of said cylinder cooling jacket chambers (3) with adjacent annular chambers merging with one another at the longitudinal plane (4) of the engine, a cylinder head gasket (300) operatively disposed between and in sealing relation with said cylinder crank casing (1) and said cylinder head (200), said cylinder head gasket (300) including openings connecting said cylinder cooling jacket chambers (3) with said annular chambers (203), the cross-section of flow of one annular chamber (203) being greater on one side of the longitudinal plane (4) than on the other side, and the adjacent annular chamber (203) having an inverse cross-section of flow relative to the longitudinal plane (4).

3. The internal combustion engine of claim 2 wherein said cylinder head (200) includes a base (202) adjacent said gasket (300) having a transverse fluid conducting borehole (204) extending between circumferentially spaced portions of said annular chamber (203).

4. The internal combustion engine of claim 3 wherein said cylinder head base (202) includes an injection nozzle opening at one side of said fluid-conducting borehole (204) and further comprising a connecting borehole (205) in said cylinder head base (202) on the other side of said fluid-conducting borehole (204) which extends at an angle of approximately 65 degrees to said fluid-conducting borehole (204), said connecting borehole (205) interconnecting said fluid-conducting borehole (204) and said annular chamber (203).

5. The internal combustion engine of claim 4 wherein said cylinder head base (202) includes an intake valve port and an exhaust valve port and wherein said fluid-conducting borehole (204) extends between said valve ports.

6. The internal combustion engine of claim 5 wherein said cylinder head (200) includes a longitudinally extending distribution conduit (211) and an axially extending borehole (210) connected at one of its ends to said fluid-conducting borehole (204) and at the other of its ends with said conduit (211).

7. The internal combustion engine of claim 6 wherein said cylinder head (200) includes a valve rocker bearing chamber (213), wherein said distribution conduit (211) extends the length of the cylinder head (200) and wherein said cylinder head (200) includes longitudinally spaced boreholes (212) extending from said distribution conduit (211) to said valve rocker bearing chamber (213).

8. The internal combustion engine of claim 7 wherein said cylinder head (200) includes an exhaust channel connected to said exhaust port and a cooling air chamber (214) disposed between said exhaust channel and said valve rocker bearing chamber (213).

9. The internal combustion engine of claim 8 wherein said cooling air chamber (214) is open at its ends and is connected to the atmosphere.

10. The internal combustion engine of claim 9 wherein said cooling air chamber (214) is so constructed as to facilitate the flow of cooling air therethrough as it flows from one lateral side of the engine to the other.

11. The internal combustion engine of claim 10 wherein said cylinder head (200) includes an exhaust valve guide adjacent to said axially extending borehole (210) and wherein the latter is formed in walls of said cylinder head (200) which extend through said cooling chamber (214).

12. The internal combustion engine of claim 11 and further comprising operating lines (215) extending through said cooling chamber (214) from one side of said engine to the other.

13. A diesel internal combustion engine having a liquid-cooled cylinder crank casing (1) including a plurality of cylinder pipes (2) whose axes lie in a longitudinal plane (4) and a cooling jacket chamber (3) surrounding each cylinder pipe (2) and a liquid-cooled cylinder head secured to said cylinder crank casing (1), characterized by a head gasket (300) operatively disposed between and in sealing relation with said cylinder crank casing (1) and said cylinder head, a longitudinally extending distribution conduit in said cylinder head, an opening (303) in said head gasket (300) communicating with at least one of said cooling jacket chambers (3), a passage in said cylinder head (200) connecting said opening (303) with said distribution conduit, a valve rocker bearing chamber in said cylinder head and laterally extending boreholes in said cylinder head interconnecting said distribution conduit with said valve rocker bearing chamber.

14. A diesel internal combustion engine having a liquid-cooled cylinder crank casing (1) including a plurality of cylinder pipes (2) whose axes lie in a longitudinal plane (4) and a cooling jacket chamber (3) surrounding each cylinder pipe (2) and a cylinder head secured to said casing, characterized by a head gasket (300) operatively disposed between and in sealing relation with said cylinder crank casing (1) and said cylinder head, a longitudinally extending distribution conduit in said cylinder head, an opening in said head gasket (300) communicating with at least one of said cooling jacket chambers (3), a passage in said cylinder head communicating with said opening and connecting said one cylinder cooling jacket chamber (3) to said distribution conduit, a valve rocker bearing chamber in said cylinder head and laterally extending boreholes in said cylinder head interconnecting said distribution conduit with said valve rocker bearing chamber.

15. The internal combustion engine of claim 14 wherein said cylinder head includes a transverse slot (103) in a location on its combustion chamber side covering an area of said cylinder head casing between adjacent cylinder pipes (2).

16. The internal combustion engine of claim 15 wherein said cylinder head includes a cooling air chamber (104) and air passages (105) connecting opposite ends of said transverse slot (103) to said cooling air chamber (104).

17. The internal combustion engine of claim 15 wherein said cooling jacket chambers (3) merge between adjacent cylinder pipes to form a cross-over passageway and wherein said cylinder head gasket (300) includes openings (302) connecting said cooling jacket chambers with opposite ends of said transverse slot (103).

18. The internal combustion engine of claim 15 wherein said gasket (300) includes openings connecting opposite ends of said slot (103) to said cylinder cooling jacket chambers (3).

19. The internal combustion engine of claim 14 wherein an annular chamber (203) is formed in the combustion chamber side of said cylinder head (200) above each of said cylinder cooling jacket chambers (3) and said cylinder head gasket includes openings connecting said cylinder cooling jacket chambers (3) with said annular chambers (203).

20. The internal combustion engine of claim 19 wherein adjacent annular chambers (203) merge with one another at the longitudinal plane (4) of the engine.

21. The internal combustion engine of claim 20 wherein adjacent cylinder cooling jacket chambers merge with one another at said longitudinal plane of the engine.

22. A diesel internal combustion engine having a liquid-cooled cylinder crank casing (1) and a cylinder head secured to said casing, characterized by a head gasket (300) operatively disposed between and in sealing relation with said cylinder crank casing (1) and said cylinder head, a cylinder pipe (2) in said cylinder crank casing (1) surrounded by a ring-shaped cylinder cooling jacket chamber (3) which is open toward said cylinder head, an annular chamber (203) in said cylinder head opening toward said cylinder crank casing (1) opposite the opening of said cooling jacket chamber (3), coolant openings (305) in the part of said head gasket (300) disposed between said cooling jacket chamber (3) and said annular chamber (203), said cylinder head including a base on its combustion chamber side in which said annular chamber (203) is formed, said cylinder head base including a transverse fluid-conducting borehole (204) extending between opposite lateral sides of said annular chamber (203) and a connecting borehole (205) extending at an angle between 50 and 80 degrees to said fluid-conducting borehole (204) interconnecting the latter and said annular chamber (203) at a point spaced circumferentially from the connection of the fluid-conducting borehole (204) with said annular chamber (203), and an opening in said head gasket connecting said cooling jacket chamber (3) to said annular chamber (203) intermediate the connections of said boreholes (204, 205) with said annular chamber (203).

23. The internal combustion engine of claim 22 and further comprising an opening (305″) in said head gasket (300) connecting said cooling jacket chamber (3) with said annular chamber (203) at a point of the latter between the two connections of said fluid-conducting borehole (204) with said annular chamber (203) on the side of said fluid-conducting borehole (204) opposite to the side of the latter on which said connecting borehole (205) is disposed.

24. A diesel internal combustion engine having a liquid-cooled cylinder crank casing (1) and a cylinder head secured to said casing, characterized by a head gasket (300) is operatively disposed between and in sealing relation with said cylinder crank casing (1) and said cylinder head, at least two cylinder pipes (2) in said cylinder crank casing (1) defining two adjacent cylinder openings, cooling jacket chambers (3) in said cylinder crank casing (1) surrounding said cylinder pipes (2), respectively, a push rod opening (306) in said head gasket (300) shaped like the number 8 positioned at one lateral side of the gasket between said two cylinder openings (304), said push rod opening (306) including a slot-like recess (307) connecting said push rod opening (306) to one of said cylinder cooling jacket chambers (3).

25. The internal combustion engine of claim 24 wherein said slot-like recess (307) is in the push rod opening (306) nearest one longitudinal end of said engine.

26. In an internal combustion engine of the type having a liquid-cooled crank casing (1) which includes a plurality of cylinder pipes (2) whose axes define the longitudinal plane (4) of the engine and a ring-shaped cooling jacket chamber (3) surrounding each cylinder pipe and which is adapted to alternatively receive a cylinder head including a base presenting a transverse slot (103) open toward said cylinder crank casing (1) in the area of the latter between said cylinder pipes (2) or a cylinder head including a base presenting annular chambers (203) aligned with said cooling jacket chambers (3), respectively, and merging in the area between said cylinder pipes (2), a head gasket (300) adapted for installation on said casing (1) for sealing the latter relative to one of said cylinder heads installed on said casing, said gasket including a pair of coolant openings (302) disposed on a line at right angles to said longitudinal plane and adapted to connect opposite ends of said slot with said cylinder cooling jacket chambers (3) when the head having the latter is installed on the casing and adapted to connect the annular chambers to said cylinder cooling jacket chambers when a cylinder head with annular chambers is secured to said casing.

* * * * *